US008348142B2

(12) United States Patent
Smalley

(10) Patent No.: US 8,348,142 B2
(45) Date of Patent: Jan. 8, 2013

(54) CARTON WITH HANDLE

(75) Inventor: Brian Smalley, Downend (GB)

(73) Assignee: Graphic Packaging International, Inc., Marietta, GA (US)

( * ) Notice: Subject to any disclaimer, the term of this patent is extended or adjusted under 35 U.S.C. 154(b) by 155 days.

(21) Appl. No.: 12/857,814

(22) Filed: Aug. 17, 2010

(65) Prior Publication Data

US 2011/0036902 A1 Feb. 17, 2011

Related U.S. Application Data

(60) Provisional application No. 61/274,435, filed on Aug. 17, 2009.

(51) Int. Cl.
*B65D 5/46* (2006.01)
*B31B 1/86* (2006.01)

(52) U.S. Cl. ..... 229/117.14; 493/88

(58) Field of Classification Search ..... 229/117.14; 493/88; 206/163, 428
See application file for complete search history.

(56) References Cited

U.S. PATENT DOCUMENTS

| | | | |
|---|---|---|---|
| 1,253,193 | A | 1/1918 | Hill |
| 2,383,183 | A | 8/1945 | Fischer |
| 2,594,376 | A | 4/1952 | Arneson |
| 2,702,144 | A | 2/1955 | Forrer |
| 2,718,301 | A | 9/1955 | Palmer |
| 2,785,847 | A | 3/1957 | Forrer |
| 2,797,856 | A | 7/1957 | Jaeschke |
| 2,810,506 | A | 10/1957 | Kessler |
| 2,868,433 | A | 1/1959 | Anderson, Jr. |
| 2,955,739 | A | 10/1960 | Collura |
| 3,112,856 | A | 12/1963 | MacIntosh et al. |
| 3,127,720 | A | 4/1964 | Gentry et al. |
| 3,204,815 | A | 9/1965 | Weiss |
| 3,309,005 | A | 3/1967 | Pilger |
| 3,334,767 | A | 8/1967 | Cornelius et al. |
| 3,355,012 | A | 11/1967 | Weiss |
| 3,381,881 | A | 5/1968 | Granz et al. |

(Continued)

FOREIGN PATENT DOCUMENTS

| | | |
|---|---|---|
| CA | 877792 | 8/1971 |

(Continued)

OTHER PUBLICATIONS

International Search Report for PCT application No. PCT/US2010/025178, mailed Sep. 2, 2010.

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A carton for containing a plurality of articles. The carton comprises a first top panel, a second top panel, a bottom panel, a first side panel, and a second side panel. A handle comprises a first handle and a second handle. The first handle comprises a first opening feature and a second opening feature. The first and second opening features of the first handle comprise a plurality of tear lines and at least one of the tear lines extends into the first side panel. The second handle comprises a first opening feature and a second opening feature. The first and second opening features of the second handle comprise a plurality of tear lines and at least one of the tear lines extends into the second side panel.

24 Claims, 8 Drawing Sheets

U.S. PATENT DOCUMENTS 3,554,402 A 1/1971 Lock
3,828,926 A 8/1974 Rossi
3,886,901 A 6/1975 Zeitler
3,904,036 A 9/1975 Forrer
3,933,303 A 1/1976 Kirby, Jr.
3,994,432 A 11/1976 Kirby, Jr.
4,029,204 A 6/1977 Manizza
4,036,423 A 7/1977 Gordon
4,096,985 A 6/1978 Wood
4,111,306 A 9/1978 Roccaforte
4,216,861 A 8/1980 Oliff
4,318,474 A 3/1982 Hasagawa
4,327,829 A 5/1982 Hughes
4,328,923 A 5/1982 Graser
4,329,923 A 5/1982 Iida
4,331,289 A 5/1982 Killy
4,364,509 A 12/1982 Holley et al.
4,375,258 A 3/1983 Crayne et al.
4,378,905 A 4/1983 Roccaforte
4,382,505 A 5/1983 Sutherland et al.
4,405,078 A * 9/1983 Dutcher et al. ..... 229/117.13
4,424,901 A 1/1984 Lanier
4,440,340 A 4/1984 Bakx
4,478,334 A 10/1984 Graser
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,558,816 A 12/1985 Wood
4,577,799 A * 3/1986 Oliff ..... 229/198.2
4,582,199 A * 4/1986 Schuster ..... 206/428
4,588,084 A 5/1986 Holley, Jr.
4,653,686 A 3/1987 Wood et al.
4,681,252 A 7/1987 Doerr et al.
4,684,059 A 8/1987 Rusnock
4,706,876 A 11/1987 Wilson
4,728,025 A 3/1988 Oliff
4,728,026 A 3/1988 Schuster
4,747,487 A 5/1988 Wood
4,784,266 A 11/1988 Chaussadas
4,784,316 A 11/1988 Crouch
4,785,991 A 11/1988 Schuster
4,802,583 A 2/1989 Calvert et al.
4,811,894 A 3/1989 Schuster
4,830,267 A 5/1989 Wilson
4,838,479 A 6/1989 Wood
4,875,586 A 10/1989 Chaussadas
RE33,110 E 11/1989 Wood et al.
4,958,734 A 9/1990 Wood et al.
4,966,324 A 10/1990 Steel
4,972,991 A 11/1990 Schuster
4,974,771 A 12/1990 Lavery
4,981,253 A 1/1991 Quaintance
5,000,313 A 3/1991 Oliff
5,002,186 A 3/1991 Cooper
5,020,337 A 6/1991 Krieg
5,060,792 A 10/1991 Oliff
5,072,876 A 12/1991 Wilson
5,094,359 A 3/1992 DeMars et al.
5,106,014 A 4/1992 Miller
5,108,030 A 4/1992 Schuster et al.
5,119,985 A 6/1992 Dawson et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,284,294 A 2/1994 Floyd
5,292,058 A 3/1994 Zoss et al.
5,292,059 A 3/1994 Oliff
5,297,725 A 3/1994 Sutherland
5,303,863 A 4/1994 Arasim
5,307,932 A 5/1994 Stout et al.
5,307,986 A 5/1994 Schuster
5,320,277 A 6/1994 Stout et al.
5,333,734 A 8/1994 Stout et al.
D350,480 S 9/1994 Sutherland
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,458,234 A 10/1995 Harris
5,480,091 A 1/1996 Stout
5,482,203 A 1/1996 Stout
5,485,915 A 1/1996 Harris
5,495,727 A 3/1996 Strong et al.
5,524,756 A 6/1996 Sutherland
5,551,556 A 9/1996 Sutherland
5,582,343 A 12/1996 Dalvey
5,639,017 A 6/1997 Fogle
5,647,483 A 7/1997 Harris
5,669,500 A 9/1997 Sutherland
5,699,957 A 12/1997 Bin et al.
5,704,470 A 1/1998 Sutherland
5,738,273 A 4/1998 Auclair
5,794,778 A 8/1998 Harris
5,796,778 A 8/1998 Harris
5,826,782 A 10/1998 Stout
5,826,783 A 10/1998 Stout
5,873,515 A 2/1999 Dunn et al.
5,878,946 A 3/1999 Frerot et al.
5,906,313 A 5/1999 Oliff
5,915,546 A 6/1999 Harrelson
5,992,733 A 11/1999 Gomes
5,996,883 A 12/1999 Bates
6,019,276 A 2/2000 Auclair
6,021,899 A 2/2000 Sutherland
6,065,590 A 5/2000 Spivey
6,105,853 A 8/2000 Lamare
6,105,854 A 8/2000 Spivey et al.
6,109,438 A 8/2000 Sutherland
6,126,066 A 10/2000 Peterson et al.
6,129,266 A 10/2000 Oliff et al.
6,131,803 A 10/2000 Oliff et al.
6,164,526 A 12/2000 Dalvey
6,170,741 B1 1/2001 Skolik et al.
6,227,367 B1 5/2001 Harrelson et al.
6,237,839 B1 5/2001 Brown
6,250,542 B1 6/2001 Negelen
6,260,755 B1 7/2001 Bates et al.
6,273,330 B1 8/2001 Oliff et al.
6,302,320 B1 10/2001 Stout
6,425,520 B1 7/2002 Peterson
6,484,903 B2 * 11/2002 Spivey et al. ..... 221/303
6,523,739 B2 2/2003 Heeley et al.
6,536,656 B2 3/2003 Auclair et al.
6,631,803 B2 10/2003 Rhodes et al.
6,758,337 B2 7/2004 Chargueraud et al.
6,766,940 B2 7/2004 Negelen
6,848,573 B2 2/2005 Gould et al.
6,905,066 B2 6/2005 Holley et al.
6,926,193 B2 8/2005 Smalley
6,942,140 B2 9/2005 Merzeau
6,968,992 B2 11/2005 Schuster
7,007,836 B2 * 3/2006 Smalley ..... 229/117.13
7,273,161 B2 9/2007 Fogle et al.
7,427,010 B2 9/2008 Sutherland
7,472,791 B2 1/2009 Spivey, Sr.
7,743,968 B2 6/2010 Theelen
7,748,603 B2 7/2010 Fogle et al.
7,757,933 B2 7/2010 Dunn
7,793,779 B2 9/2010 Spivey, Sr. et al.
7,806,314 B2 10/2010 Sutherland
2003/0213263 A1 11/2003 Woog
2004/0074854 A1 4/2004 Fogle et al.
2005/0056658 A1 3/2005 Spivey
2005/0167478 A1 8/2005 Holley, Jr.
2006/0169755 A1 8/2006 Spivey, Sr.
2006/0273143 A1 12/2006 Finch
2007/0017962 A1 1/2007 Russ
2007/0029371 A1 * 2/2007 Theelen ..... 229/117.13
2007/0039846 A1 2/2007 Spivey
2007/0051781 A1 3/2007 Holley, Jr.
2007/0108261 A1 5/2007 Schuster
2007/0164091 A1 7/2007 Fogle et al.

| | | | |
|---|---|---|---|
| 2007/0181658 | A1 | 8/2007 | Sutherland |
| 2007/0205255 | A1 | 9/2007 | Dunn |
| 2007/0295789 | A1 | 12/2007 | Ho Fung |
| 2008/0067223 | A1 | 3/2008 | Jego |
| 2008/0073420 | A1 | 3/2008 | Walling et al. |
| 2009/0236408 | A1 | 9/2009 | Spivey, Sr. et al. |
| 2010/0213249 | A1 | 8/2010 | Requena et al. |

FOREIGN PATENT DOCUMENTS

| | | | |
|---|---|---|---|
| CA | 2 160 145 | | 9/1995 |
| DE | 85 14 718.4 | | 6/1985 |
| DE | 296 07 374 | U1 | 4/1996 |
| DE | 201 12 228 | U1 | 11/2002 |
| DE | 2004 018 649 | | 4/2005 |
| EP | 0473 266 | | 3/1992 |
| EP | 1 612 157 | | 1/2006 |
| WO | WO 96/27538 | | 9/1996 |
| WO | WO 99/28207 | | 6/1999 |
| WO | WO 00/78618 | A1 | 12/2000 |
| WO | WO 01/66434 | A1 | 9/2001 |
| WO | WO 03/037742 | A2 | 5/2003 |
| WO | WO/2005/080218 | | 9/2005 |
| WO | WO 2005/123532 | | 12/2005 |
| WO | WO/2007/089282 | | 8/2007 |
| WO | WO 2009/117562 | A1 | 9/2009 |

OTHER PUBLICATIONS

Written Opinion for PCT application No. PCT/US US2010/025178, mailed Sep. 2, 2010.

PCT/US2009/037642—International Search Report and Written Opinion, mailed May 29, 2009.

PCT/US2010/025177, ISR mailed Sep. 2, 2010.

PCTUS2010/025177, WO mailed Sep. 2, 2010.

International Search Report and Written Opinion for PCT/US2011/030461 dated Dec. 26, 2011.

* cited by examiner

CARTON WITH HANDLE

CROSS REFERENCE TO RELATED APPLICATION

This application claims the benefit of the filing date of U.S. Provisional Application No. 61/274,435, filed Aug. 17, 2009 is hereby claimed.

INCORPORATION BY REFERENCE

U.S. Provisional Patent Application No. 61/274,435, which was filed on Aug. 17, 2009, is hereby incorporated by reference for all purposes as if presented herein in its entirety.

BACKGROUND OF THE DISCLOSURE

The present disclosure generally relates to paperboard cartons for holding and carrying containers such as beverage cans. More specifically, the disclosure relates to a carton having a handle by which the carton and its contents can be carried.

SUMMARY OF THE DISCLOSURE

In one aspect, a carton for containing a plurality of articles comprises a plurality of panels that extend at least partially around and define an interior of the carton. A handle is formed by a first handle portion and a second handle portion in the top panel. The handle has features that extend into the side panels. When the handle is grasped and pulled up, these features break and displace to allow the handle to project upwardly from the carton for carrying. Further, an interlocking function of these features holds the handle in its upwardly projecting easily graspable configuration.

In another aspect, a carton comprises a plurality of panels that extends at least partially around an interior of the carton. The plurality of panels comprises a first top panel, a second top panel, a bottom panel, a first side panel, and a second side panel. The first top panel and the second top panel are at least partially overlapped to form a double ply top wall of the carton. A handle is formed by a first handle portion in the first top panel and a second handle in the second top panel registered with the first handle portion. The first handle portion comprises a first opening feature and a second opening feature. The first and second opening features of the first handle portion comprise a plurality of tear lines and at least one of the tear lines extends into the first side panel. The second handle portion comprises a first opening feature and a second opening feature. The first and second opening features of the second handle comprise a plurality of tear lines and at least one of the tear lines extends into the second side panel. Again, when the handle is accessed and pulled upwardly for carrying the carton, the tear lines break, displace, and interlock with the top of the carton to hold the handle in its deployed configuration for easy further grasping. In the process, stress caused by the weight of the carton and its contents is transferred to the sides of the carton, making the handle stronger and less prone to breaking.

In another aspect, a blank for forming the cartons of this disclosure comprises a plurality of panels including a first top panel, a second top panel, a bottom panel, a first side panel, and a second side panel. Handle features are formed in the first top panel and the second top panel and extend partially into the first side panel and the second side panel. The handle features cooperate to define a handle in a carton erected from the blank. A first handle portion is arranged in the first top panel and comprises a first opening feature and a second opening feature. The first and second opening features each comprise a first arcuate tear line at a first end of the opening feature, a second arcuate tear line at a second end of the opening feature with the second arcuate tear line terminating at a fold line between the first top panel and the adjacent side panel. A tear line extends from the fold line cut into the first side panel and has a hook shaped portion in the side panel. The second handle portion in the second top panel has a first opening feature and a second opening features and the first and second opening features each comprise a first arcuate tear line at a first end of the opening feature. A second arcuate tear line at a second end of the opening feature terminates at the fold line connecting the second top panel and the second side panel. A fold line cut proximate the second arcuate tear line extends along the fold line and a tear line extends from the fold line cut into the second side panel and has a hook shaped portion.

In another aspect, a method comprises providing a blank having a plurality of panels. The plurality of panels include a first top panel, a second top panel, a bottom panel, a first side panel, a second side panel, a first handle portion in the first top panel, and a second handle portion in the second top panel. The first handle portion comprises a first and second opening feature in the first top panel and extending into a first side panel. The second handle portion comprises a first and second opening feature in the second top panel and extending into a second side panel. The method comprises forming a top wall of the carton by at least partially overlapping the first top panel and the second top panel and aligning or registering a plurality of center tear lines of the first handle portion with a plurality of center tear lines of the second handle portion to form a double ply handle.

Those skilled in the art will appreciate the above stated features and benefits of the carton of this disclosure by reading the following detailed description of the embodiments with reference to the accompanying drawing figures. It is within the scope of the present disclosure that the above-discussed features be provided both individually and in various combinations.

According to common practice, the various features of the drawings are not necessarily drawn to scale. Dimensions of various features and elements in the drawings may be expanded or reduced to illustrate more clearly the embodiments of the disclosure.

BRIEF DESCRIPTION OF THE DRAWINGS

Corresponding parts are designated, where appropriate, by corresponding reference numbers throughout the drawings.

DETAILED DESCRIPTION OF THE EXEMPLARY EMBODIMENTS

The present disclosure generally relates to constructs, sleeves, cartons, or the like, and packages for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Packages according to the present disclosure can accommodate containers of numerous different shapes. For the purpose of illustration and not for the purpose of limiting the scope of the disclosure, the following detailed description describes beverage containers at least partially disposed within the package embodiments. In this specification, the terms "lower," "bottom," "upper" and "top" indicate orientations determined in relation to fully erected packages.

Figure 1:
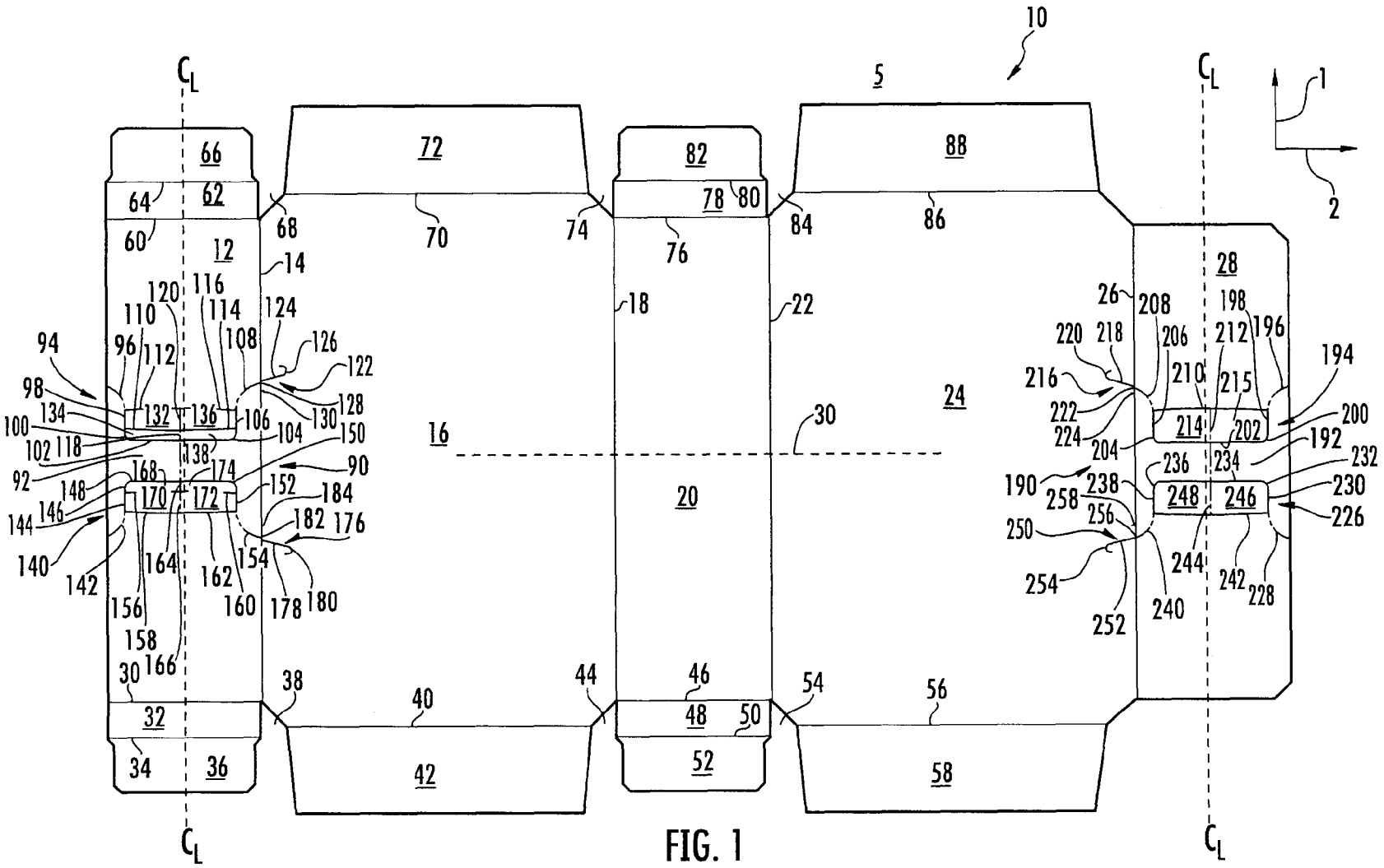
FIG. 1 is a plan view of a blank used to form a carton.

FIG. 1 is a plan view of a blank 10 used to form the carton 300 shown in FIGS. 4-7. The blank 10 has a lateral axis L1 and a longitudinal axis L2, and a peripheral portion 5 shown to the exterior of blank 10. Blank 10 as illustrated is generally symmetric about an axis of symmetry 3 extending in the longitudinal direction. Blank 10 includes a generally rectangular top panel 12 foldably connected along a fold line 14 to a side panel 16. Side panel 16 is foldably connected along a fold line 18 to a generally rectangular bottom panel 20. Bottom panel 20 is foldably connected along fold line 22 to side panel 24. Side panel 24 is connected along fold line 26 to a generally rectangular top panel 28. Panels 16, 24, and 28 are generally rectangular, but may include at least one angled corner 38, 44, 54, 68, 74, 84. If all four corners are angled, the panels 16, 24, and 28 will form a slightly octagonal shape at their angled corners. Since top panel 28 folds under top panel 12 when blank 10 is formed into carton 300, top panel 28 has a width (as measured in the longitudinal direction L2) that is shorter than top panel 12 to insure proper formation of the carton 300.

End flaps 36, 42, 52, 58, 66, 72, 82, 88 are generally included along first and second ends of panels 12, 16, 20, and 24 of blank 10. The end flaps 36, 52, 66, 82 attached to panels 12 and 20 also include intermediate panels 32, 48, 62, 78 to allow articulation about non-rectangular items when blank 10 is formed into the carton 300. Specifically, at a first end of the blank 10, an intermediate panel 32 is connected along fold line 30 to top panel 12, and end flap 36 is connected to intermediate panel 32 along fold line 34. As shown in FIG. 1, end flap 36 generally, though not necessarily, has a smaller width than intermediate panel 32 or top panel 12. Further, end flaps 52, 66, and 82 generally, though not necessarily, have a smaller width than their respective intermediate panel 48, 62, and 78 or top panel 12 and bottom panel 20, respectively. Intermediate panel 32 and end flap 36 are separated from connection with side panel 16 by a gap 38. End flap 42 is connected along fold line 40 to side panel 16. End flap 42 is separated from connection with bottom panel 20 by a gap 44. Intermediate panel 48 is connected along fold line 46 to bottom panel 20, and end flap 52 is connected along fold line 50 to intermediate panel 48. Intermediate panel 48 and end flap 52 are separated from connection with side panel 24 by a gap 54. End flap 58 is foldably connected along fold line 56 to side panel 24.

At a second end of the blank 10, intermediate panel 62 is foldably connected along a fold line 60 to top panel 12. End flap 66 is connected along fold line 64 to intermediate panel 62. Intermediate panel 62 and end flap 66 are separated from side panel 16 by a gap 68. An end flap 72 is connected along a fold line 70 to side panel 16. End flap 72 is separated from bottom panel 20 a gap 74. Intermediate panel 78 is connected along a fold line 76 to bottom panel 20. End flap 82 is connected along a fold line 80 to intermediate panel 78. Intermediate panel 78 and end flap 82 are separated from side panel 24 by a gap 84. End flap 88 is connected along a fold line 86 to side panel 24. Gaps 38, 44, 54, 68, 74, 84 facilitate construction of the carton and also allow articulation about non-rectangular items when blank 10 is formed into a carton.

Blank 10 includes at least a first handle feature 90 and a second handle feature 190. The first handle feature 90 and the second handle feature 190 collectively form handle 91 (see FIG. 7). Handle 91 may have at least two plies formed by the overlapping top panels 12 and 28. As shown in FIG. 1, first handle feature 90 includes a handle panel 92 defined between opening features 94 and 140. Opening feature 94 includes several portions defined by a plurality of tear lines and fold lines. The opening feature 94 generally extends in top panel 12 from peripheral portion 5 of the blank 10 along arcuate tear line 96, to tear line 98, which may be generally parallel with fold line 14, to arcuate tear line 100, to a cut/crease line 102, which extends generally perpendicular to tear line 98. The opening feature 94 continues from cut/crease line 102, to arcuate tear line 104, to tear line 106, which may be generally parallel tear line 98, to arcuate tear line 108, and then to fold line 14. The opening feature 94 is generally offset from a center line $C_L$ of top panel 12 toward the free edge of the top panel. The offset of the handle feature 90 from the center of the top panel 12, among other things, equalizes the gluing areas when the blank 10 is folded into carton 300, especially when taking into account the panel set backs. Tear lines 110 and 112 extend between tear line 98 and center tear lines 118, 120 to form panels 132 and 134. Tear lines 114 and 116 extend between tear line 106 and center tear lines 118, 120 to form panels 136 and 138. Center tear lines 118 and 120 may be located at about the center of the opening feature 94 and be parallel with the center line $C_L$ of panel 12 and may be offset from the center line $C_L$ of panel 12. To allow maximum glue area when folded, tear lines 110 and 112 are generally perpendicular to tear line 98, and tear lines 114 and 116 are generally perpendicular to tear line 106.

Figure 2:
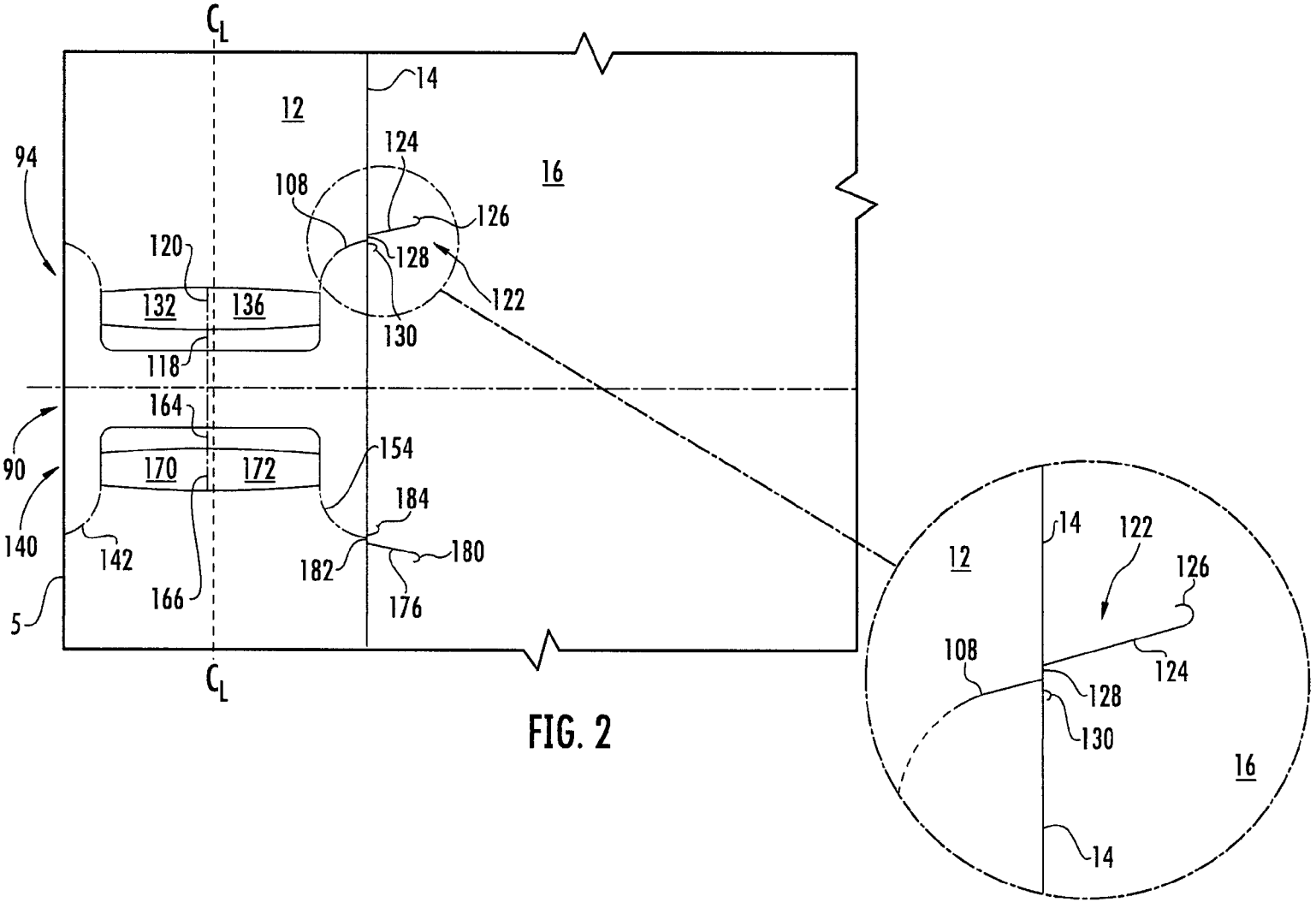
FIG. 2 shows an enlarged view of a handle feature from the blank of FIG. 1.

As shown in FIG. 1 and with specific reference to the enlarged detail provided in FIG. 2, opening feature 94 includes cut portions 122. Cut portions 122 extend along fold line 14 and extend into side panel 16. Specifically, cut portions 122 include tear line 124 that extends from fold line 14 into side panel 16 to a dog leg turn or hook portion 126, a fold line cut 128 that extends along fold line 14 between the intersection of tear line 124 and a cut 130, with cut 130 extending from fold line 14 into side panel 16. The arcuate tear line 108 generally intersects with fold line 14 along fold line cut 128. The dog leg turn or hook portion 126 at least functions at least somewhat to prevent fold line cut 128 from extending further into side panel 16 when the handle 91 is erected.

Opening feature 140 is substantially similar to a mirror image of opening feature 94. The opening feature 140 generally extends in top panel 12 from peripheral portion 5 of the blank 10 along arcuate tear line 142, to tear line 144, which may be generally parallel fold line 14, to arcuate tear line 146, to a cut/crease line 148, which extends generally perpendicular to tear line 144. The opening feature 140 continues from cut/crease line 148, to arcuate tear line 150, to tear line 152, which may be generally parallel with tear line 144, to arcuate tear line 154, and then to fold line 14. The opening feature 140 is generally offset from the center line $C_L$ of panel 12 with center tear lines 164 and 166 spaced similar distances from the center line $C_L$. In general, the offset of the handle from the center of the panel, among other things, equalizes the gluing areas when the blank 10 is folded into carton 300, especially when taking into account the panel set backs. A panel set back arises because the top panels 12, 28 may have different widths. Tear lines 156 and 158 extend between tear line 144 and center tear lines 164, 166 to form panels 168 and 170. Tear lines 160 and 162 extend between tear line 152 and center tear lines 164, 166 to form panels 172 and 174. To allow maximum glue area when folded, tear lines 156 and 158 may be generally perpendicular to tear line 144 and tear lines 160 and 162 may be generally perpendicular to tear line 152. Center tear lines 118, 120, 164, and 166 may be spaced similar distances from the center line $C_L$.

As further shown in FIG. 1, opening feature 140 includes cut portions 176 that extend along fold line 14 and extend into panel 16. Specifically, cut portions 176 include tear line 178 that extends from fold line 14 into side panel 16 to a dog leg turn or hook portion 180, a fold line cut 182 that extends along fold line 14 between the intersection of tear line 178 and a cut 184, with cut 184 extending from fold line 14 into panel 16. The arcuate tear line 154 generally intersects with fold line 14 at fold line cut 182. When the carton is lifted by the handle panel 92, the first handle feature 90 pulls inwardly from the sides of top panel 12. This causes the curved tear lines 96, 108, 142, and 154 to sever. This, in turn, causes the tear lines in the side panels to sever down to their hook features. As a result, the weight of the carton and its contents is borne by the side panels 16 and 24 reducing the likelihood of tearing and handle failure.

Second handle feature 190 includes a handle panel 192 defined between opening features 194 and 226. Opening feature 194 includes several portions defined by tear lines and fold lines. The opening feature 194 generally extends in top panel 28 from peripheral portion 5 of the blank 10 along arcuate tear line 196, to tear line 198, which may be generally parallel fold line 26, to arcuate tear line 200, to a cut/crease line 202, which extends generally perpendicular to tear line 198. The opening feature 194 continues from cut/crease line 202, to arcuate tear line 204, to tear line 206, which may be generally parallel tear line 198, to arcuate tear line 208, and then to fold line 26. The opening feature 194 is generally offset from a center line $C_L$ of top panel 28 with center tear line 212 spaced from the center line $C_L$. The offset of the handle from the center of the top panel 28, among other things, equalizes the gluing areas when the blank 10 is folded into carton 300, especially when taking into account the panel set backs. Tear line 210 extends between tear lines 198 and 206 to form panels 214 and 215, which are separated by center tear line 212. To allow maximum glue area when folded, tear line 210 is generally perpendicular to tear line 198 and tear line 206.

Opening feature 194 includes cut portions 216 that extend along fold line 26 and that extend into side panel 24. Specifically, cut portions 215 include tear line 218 that extends from fold line 26 into panel 24 to a dog leg turn or hook portion 220, a fold line cut 222 that extends along fold line 26 between the intersection of tear line 218 and a cut 224, with cut 224 extending from fold line 26 into side panel 24. The arcuate tear line 208 generally intersects with fold line 26 at fold line cut 222.

Opening feature 226 is substantially similar to a mirror image of opening feature 194. The opening feature 226 generally extends in top panel 28 from peripheral portion 5 of the blank 10 along arcuate tear line 228, to tear line 230, which may be generally parallel fold line 26, to arcuate tear line 232, to a cut/crease line 234, which extends generally perpendicular to tear line 230. The opening feature 226 continues from cut/crease line 234, to arcuate tear line 236, to tear line 238, which may be generally parallel tear line 230, to arcuate tear line 240, and then to fold line 26. The opening feature 226 is generally offset from the center line $C_L$ of top panel 28 with center tear line 244 spaced from the center line $C_L$. Tear line 242 extends between tear lines 230 and 238 to form panels 246 and 248, which are separated by center tear line 244. To allow maximum glue area when folded, tear line 242 is generally perpendicular to tear line 230 and tear line 238.

Since the top panels 12 and 28 are different widths to accommodate their overlap when folding the blank 10 to form the carton 300, the center tear line offsets are different for top panels 12 and 28. Once folded however, and accounting for the difference in widths, the center tear lines 118, 120, 164, 166, 212, and 244 are disposed generally parallel, with center tear lines 118, 120, 164, and 166 disposed generally above center tear lines 212 and 244. The folded over or overlapped top panels 12, 28 form a top wall of the carton 300. The offset of the handle from the center of the panel, among other things, equalizes the gluing areas when the blank 10 is folded into carton 300, especially when taking into account the panel set backs. As an example, if the width of top panel 12 is 116 millimeters (mm), the width of the bottom panel 20 is 117 mm, and the width of top panel 28 is 113 mm (the 3 mm difference allowing ease of creating the carton 300 without interference of the fold line 14 with the peripheral end of panel 28). In this example, center tear lines 118, 120, 164, and 166 are spaced 56 mm from the peripheral free end of top panel 12 and spaced 60 mm from the fold line 14, while tear lines 212 and 244 are spaced 56 mm from the peripheral free end of top panel 28 and spaced 57 mm from the fold line 26. Thus, when folding the top panels 12, 28 into position to form the carton 300, tear lines 118, 120, 164, 166, and tear lines 212 and 244 align to be spaced equidistant from the center line $C_L$, which is at 58.5 mm. The spacing, or offset, in this example is 1.5 mm from center line $C_L$ when the carton 300 is formed. This offset allows equal areas for application of glue (which will be maximized on the carton) on each side of the opening features 94, 140, 194, and 226. Thus, the amount of offset of the handle is determined generally by the difference in widths between the panels being glued together.

Opening feature 226 includes cut portions 250 that extend along fold line 26 and that extend into side panel 24. Specifically, cut portions 250 include tear line 252 that extends from fold line 26 into side panel 24 to a dog leg turn or hook portion 254, a fold line cut 256 that extends along fold line 26 between the intersection of tear line 252 and a cut 258, with cut 258 extending from fold line 26 into side panel 24. The arcuate tear line 240 generally intersects with fold line 26 at fold line cut 256. The j-hook features or portions provided in the side walls, shown at 126, 180, 220, and 254, generally stop the cuts from extending beyond their intended length by tearing or otherwise.

Additionally, the arcuate tear lines 96, 108, 142, 154, 196, 208, 228, and 240 generally extend to an approximately 90-degree turn (at the intersection of 98 and 112 for 96, at the intersection of 106 and 116 for 108, at the intersection of 144 and 158 for 142, at the intersection of 152 and 162 for 154, at the intersection of 198 and 210 for 196, at the intersection of 206 and 210 for 208, at the intersection of 230 and 242 for 228, and at the intersection of 238 and 242 for 240) or as close as possible. Generally, the squarer the angle, the greater the area available to receive glue, forming a stronger handle 91.

Figure 3:
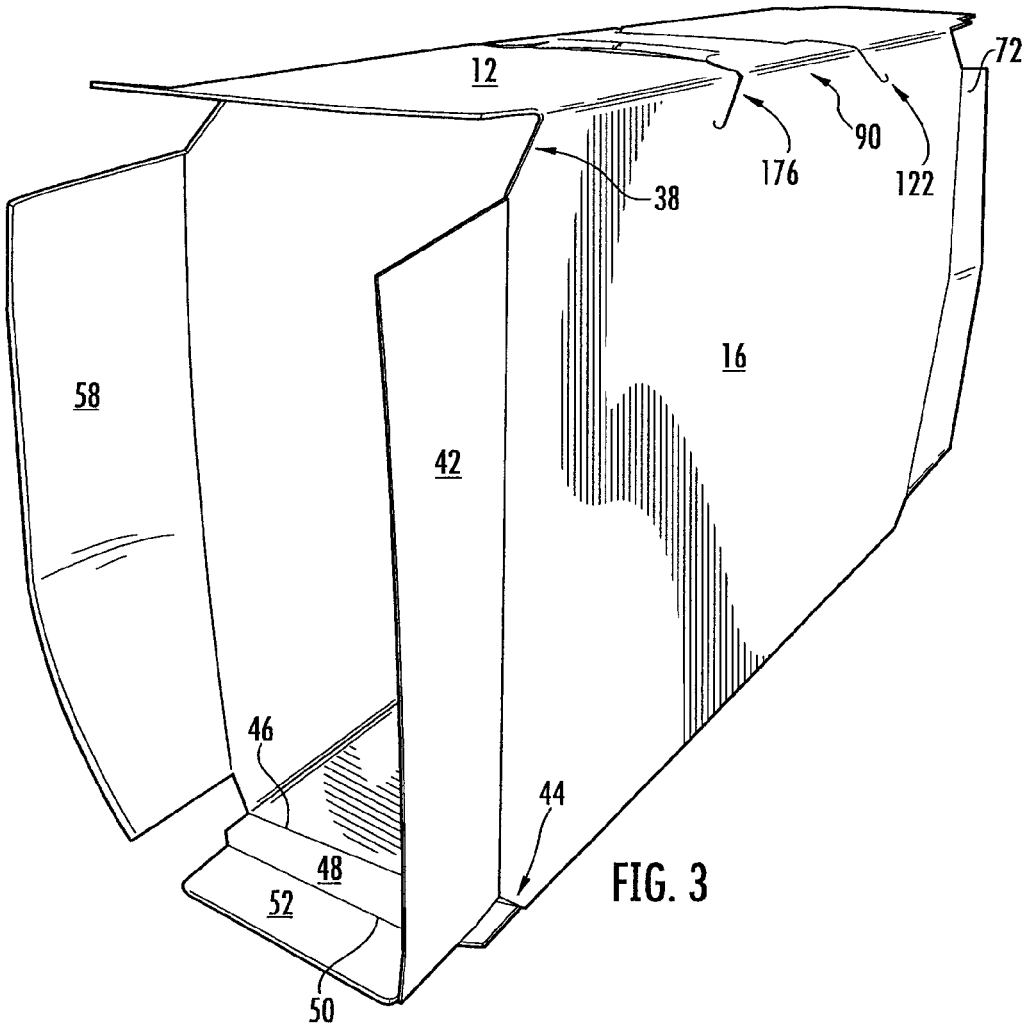
FIG. 3 shows a sleeve formed from the blank of FIG. 1.

FIG. 3 shows a sleeve formed from the partially erected blank of FIG. 1. Generally, to form the sleeve shown in FIG. 3, the blank 10 is first folded along fold lines 14, 18, 22, and 26. The top panel 28 is folded under top panel 12, and adhesive may be applied to top panel 28 to adhere top panel 28 and top panel 12 together. As erection of the carton continues, end flaps and intermediate flaps may be folded about respective fold lines and overlapped with respect to one another and may at least partially form a closed end on one or both ends of the carton 300.

An exemplary method of erecting the carton 300 is discussed in detail below and with reference to FIGS. 3-8. At various stages of the erecting process, glue or other adhesive can be applied to the an exterior side of a portion of the top panel 28 and respective portions of the end flaps 36, 66 of top panel 12. Glue can also be applied to portions of the appropriate surfaces (i.e., interior or exterior surfaces) of the end flaps 42, 52, 58, 72, 82 and 88. Further, glue may be alternatively applied to other flaps and/or panels. The blank 10 is first positioned with the exterior surface down. The blank 10 is folded at the fold lines 14, 18, 22, and 26 to position the top panel 28 beneath or underlying top panel 12 in an overlapping fashion. The first handle feature 90 is in face-to-face contact and aligned or registered with the second handle feature 190. The first handle feature 90 and the second handle feature 190 are aligned when center tear lines 118, 120 align with center tear line 212 and center tear lines 164, 166 align with center tear line 244. Top panel 12 may be adhered with top panel 28 when the first handle feature 90 and second handle are aligned as described.

The partially erected blank 10 of FIG. 3 can be assembled into a open-ended sleeve by closing the end flaps on one end so that containers such as beverage cans can be loaded into the sleeve from the opposite open end. After loading the containers, the ends can be closed by at least partially overlapping and adhering the end flaps 36, 42, 52, 58 at the open end of the carton and, if not previously closed, at least partially overlapping and adhering the end flaps 66, 72, 82, 88 at the other end of the carton. The ends of the carton 300 can be closed by other closing steps and features and in different orders.

When the carton is closed and contains articles such as beverage cans, the handle 91 can be accessed by forcing one's fingers through the opening features along tear lines 110, 114, 156, 160. This causes the opening features 94 and 140 to break along tear lines 110 and 156 and to break along fold lines 210 and 242. The resulting freed flaps then fold inwardly into the carton. One can then grasp the handle panels 92 and 192 in preparation for lifting the carton by its handle. The subsequent lifting upward of handle panels 92 and 192 severs arcuate cuts 96, 108, 142, 154, 194, 208, 228, 240 and tear lines 124, 178, 218, 252 allowing the handle to move upwardly to project from the top of the carton. The deployed handle may be lifted to carry the carton.

Figure 4:
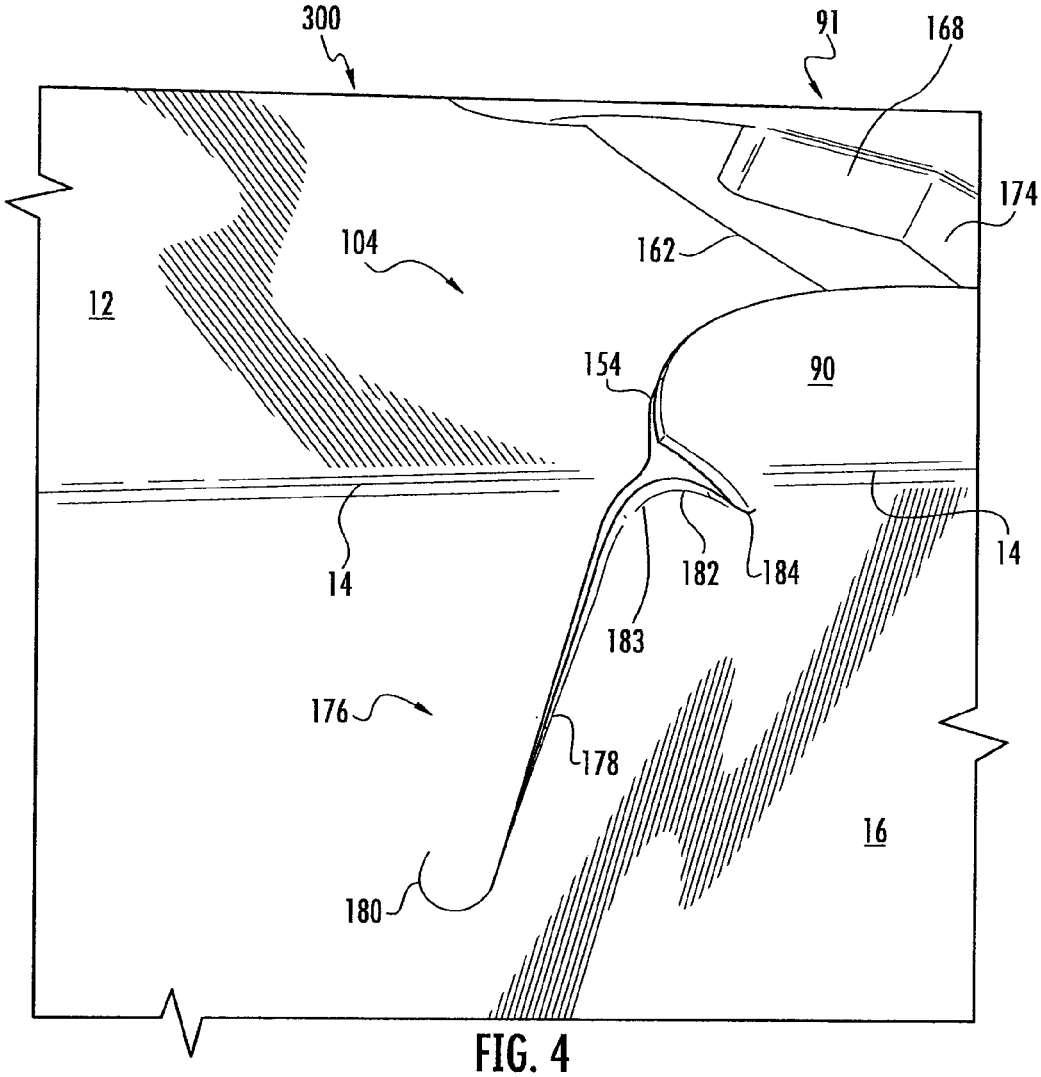
FIG. 4 shows an enlarged view of the upper and lower hook portions of the handle feature.

FIG. 4 shows an enlarged view of the upper and lower hook portions of the opening feature that extend into the side panel 16 of the erected carton. For discussion purposes only, the opening feature 104 will be discussed here in detail, but it is understood that the opening features 94, 140, 194 and 226 are substantially similar and that the discussion of opening feature 104 is generally applicable to opening features 94, 194 and 226. Referring to FIG. 4, arcuate tear line 154 of the opening feature 104 intersects fold line 14 between the top 12 and side 16 of the carton and also intersects tear line 182 that is formed along the fold line 14. Preferably, the arcuate tear line 154 intersects the tear line 182 at a predetermined location between its ends. Tear line 178 extends downwardly from the left end of the tear line 182 into the side panel 16 and terminates in J or hook-shaped end 180. With this configuration, when the handle 91 is lifted upward, arcuate tear line 154 in top panel 12 is broken or severed, tear line 182 is broken or severed along its rather short length to form a slot with a slightly hook-shaped end 184, and tear line 178 in side panel 16 is broken or severed down to the hook-shaped feature 180. In FIG. 4, these tear lines are shown already severed. It will be understood that the same severing action occurs at the other three corners of the handle feature of the carton as the handle is lifted upwardly.

With continued reference to the one feature 104, the severing of the various tear lines as described forms a shoulder 183 between the upper end of the severed tear line 178 and the left end of the severed tear line 182. As the handle 91 is pulled further upward, the shoulder 183 begins to slide progressively inward beneath the top 12 and riding along the inside surface of the top. At the same time, the arcuate edge formed by the severing of arcuate tear line 154 progressively moves into the slot formed on the right hand side of severed tear line 182. At the end of this slot, the arcuate edge is engaged by the hook-shaped end 184 of the slit, which causes the arcuate edge essentially to lock or wedge in place within the slot. Of course, this happens simultaneously at all four corners of the handle. The ultimate result is that the handle, once pulled upwardly to its deployed configuration, remains in its upwardly extending deployed configuration. It can thus be grasped easily again and again when it is desired to carry the carton and its contents.

Figure 5:
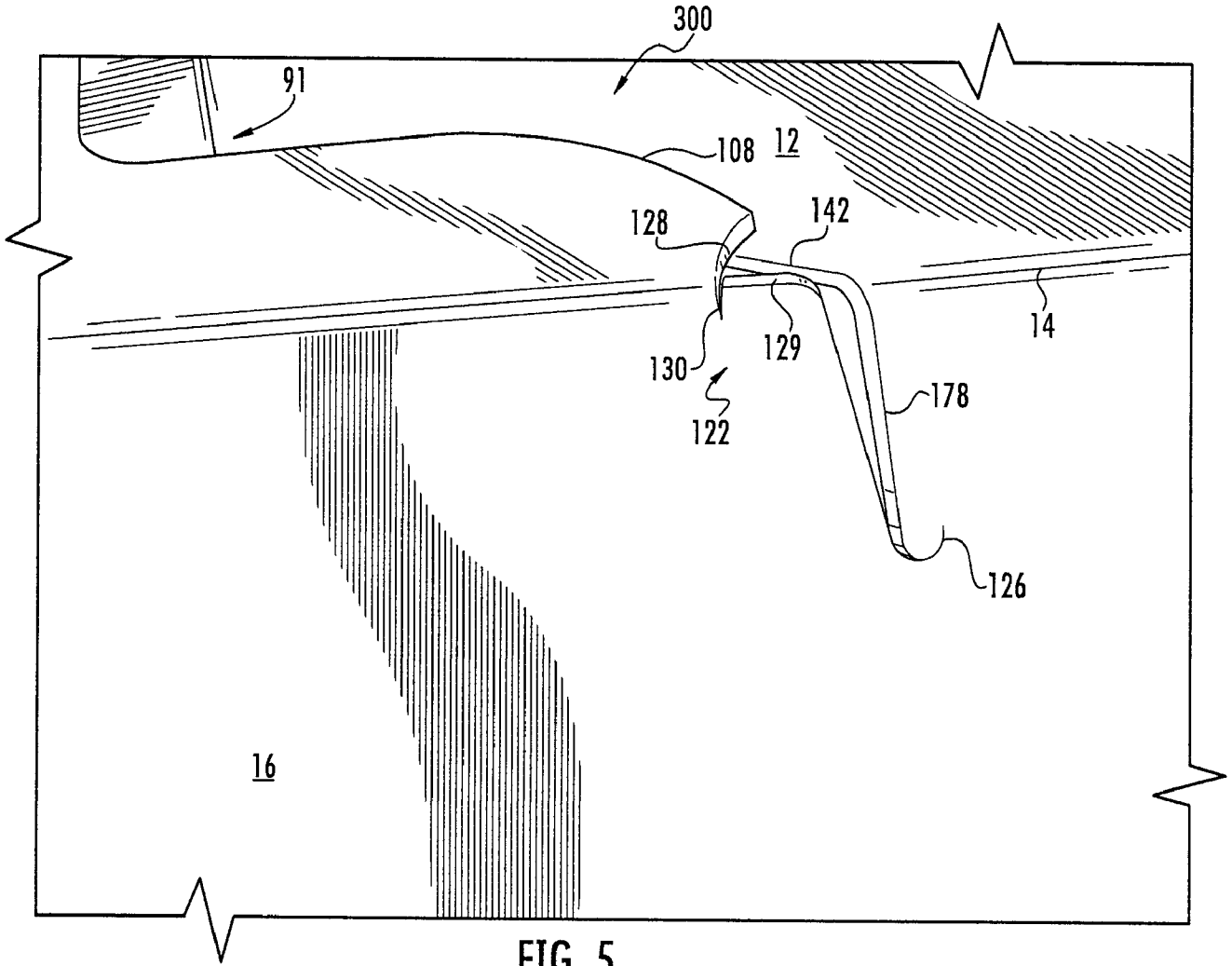
FIG. 5 shows the enlarged view of the hook portions sliding down the arcuate tear line.
Figure 6:
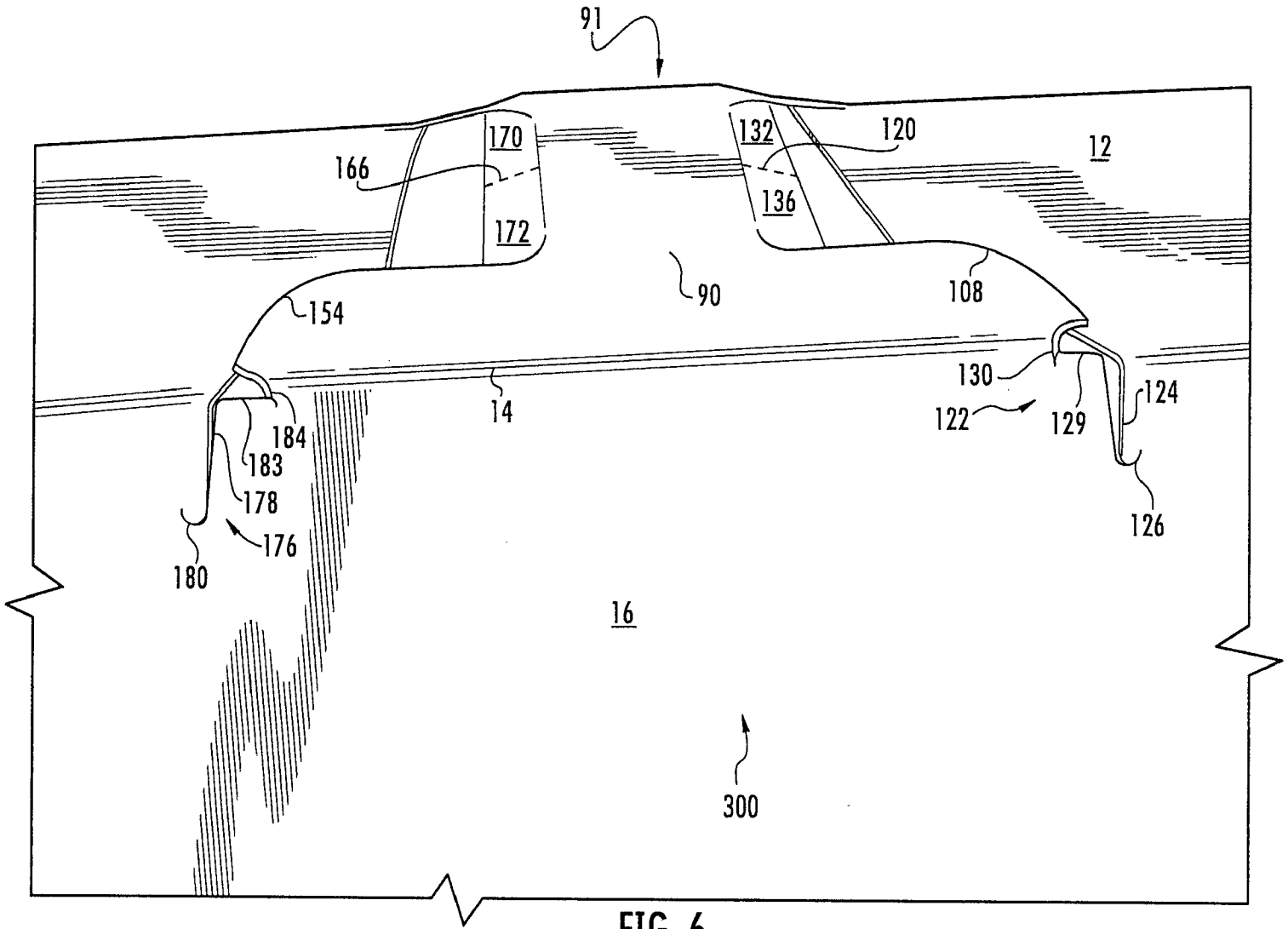
FIG. 6 shows a view of both sides of the handle engaged as shown in FIG. 5.
Figure 7:
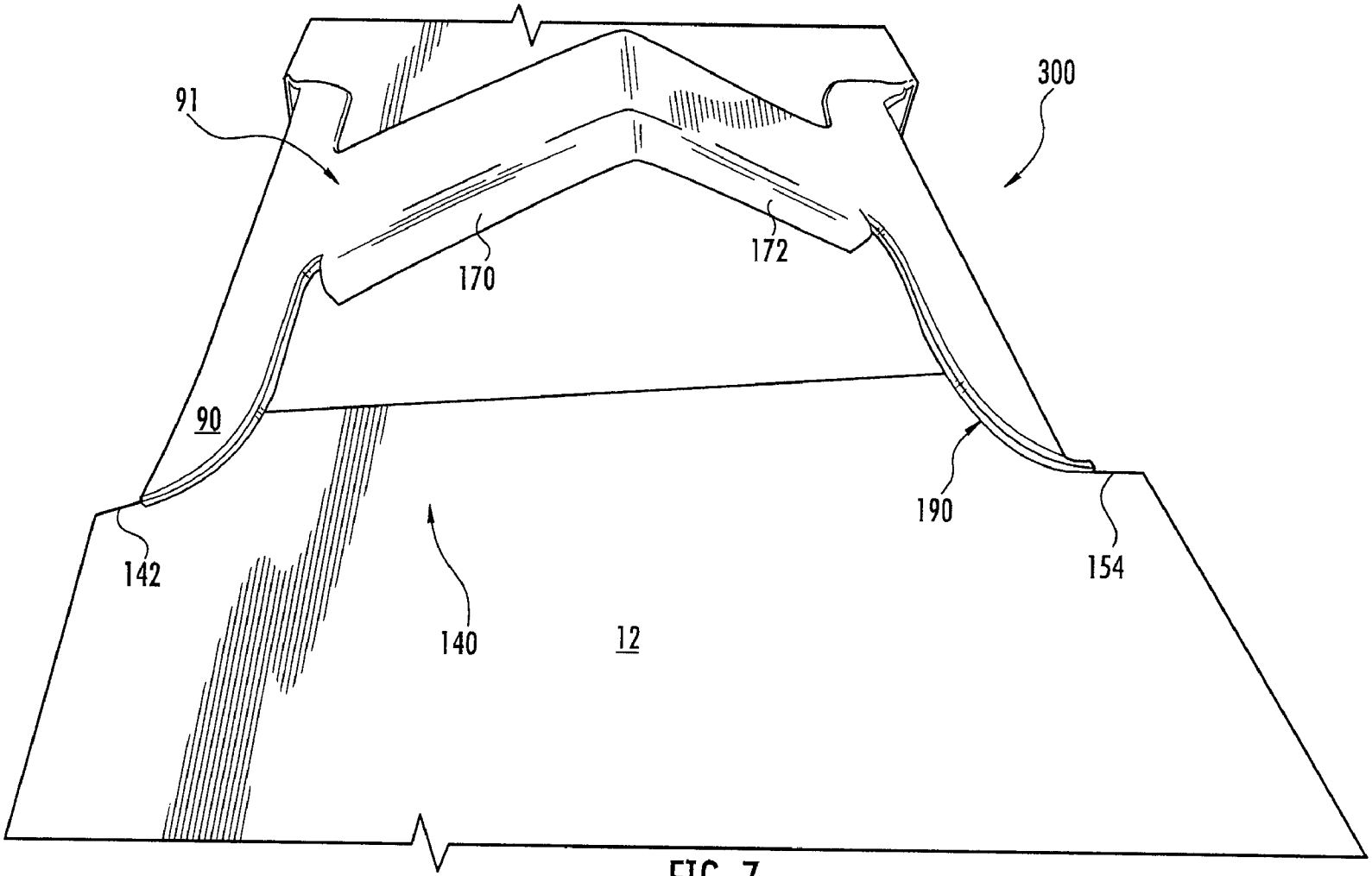
FIG. 7 shows the handle fully engaged with the notches in the upper hook portions slid to a stopping point along the arcuate tear lines.

FIGS. 5-7 illustrate the just described progression when pulling the handle 91 upwardly to its deployed configuration. In FIG. 5, handle 91 is in the process of being lifted upwardly toward its deployed configuration. The side panel 16 is Pdeflecting inwardly on the inside of the severed tear line 178. Simultaneously, the shoulder (183 in FIG. 4, but not visible in FIG. 5) is sliding inwardly beneath the top 12 of the carton and the arcuate edge left by severed tear line 142 is sliding into the slot formed by severed tear line 128 toward engagement with the hook-shaped end of the slot. When the arcuate edge encounters the hook-shaped end of the slot, the slot grips the arcuate edge to hold the handle in place in its upwardly extending deployed configuration.

FIG. 6 shows that the same action occurs at other corners of the handle feature as the handle is lifted upwardly by a user. The shoulders 129, 183 have moved in FIG. 6 inwardly and are resting against the inner surface of the top wall. As the handle 91 is lifted further, the shoulders slide along the inner surface of the top wall until the hook-shaped ends of the slots engage and grip onto the arcuate edges formed by severed tear lines 154, 142, 96, and 108. At this point, the sides of the container in the region of the handle feature are prevented from moving in further and the handle is held in its upwardly extending deployed configuration as discussed above. FIG. 7 shows the handle 91 fully deployed with the notches in the upper hook portions slid to a stopping point along the arcuate tear lines 142, 154. Cut 130 in conjunction with fold line cut 128, cut 184 in conjunction with fold line cut 182, cut 224 in conjunction with fold line cut 222, and cut 258 in conjunction with fold line cut 256 each form additional J-hook type features that act as retaining slips or slides for the handles 90 and 190. As shown in detail in FIGS. 4-7, these cuts create notches in carton 300 that allow the handles 90 and 190 to slide along the arcuate tear lines 96, 108, 142, 154, 196, 208, 228, and 240. The handles 90 and 190 will generally slide along the curvature of the arcuate tear lines 96, 108, 142, 154, 194, 208, 228, 240 until the resistance from the curvature arrests the slide, which generally is when the width of the handles between the notches is fully received along a pair of respective arcuate tear lines.

Figure 8:
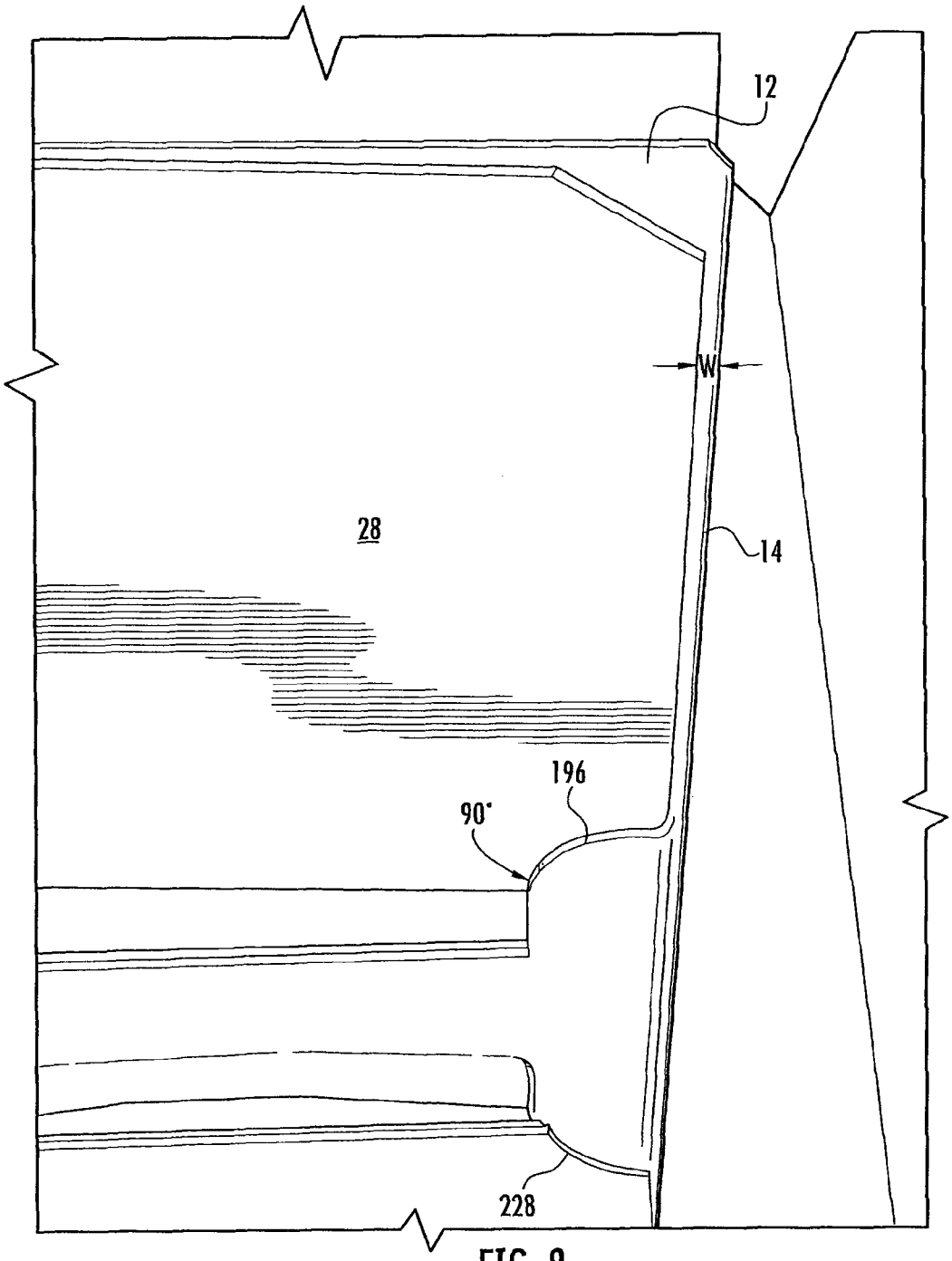
FIG. 8 shows a view of the inside of the carton showing the offset handle spacing and the adhesion of the panels together a distance from the fold lines.

FIG. 6 shows carton 300 with panels 12 and 16 folded along fold line 14 and, although not visible in FIG. 6, but shown in FIG. 8, panel 28 underlies panel 12 and is secured thereto. The handle portion 90 and the handle portion 190 underlying it have been separated along their tear lines to a depolyed or carrying configuration. As can be seen, the act of pulling up on the handle panels has caused the curved tear lines (108 is visible in FIG. 6) to sever and the tear lines (124 is visible) in the side panel to sever down to their hook features (126 is visible in FIG. 6). As the carton is lifted by the handle, its weight is transmitted to the side panels and converted to in-plane stress in the side panels 16 and 24 rather than out-of-plane stress in the top panels 12 and 28. As a result, the carton is less likely to tear under its own weight as the carton is carried.

FIG. 8 shows a view of the inside of the carton showing the offset handle spacing and the adhesion of the panels together a distance from the fold lines. The spacing of the panel 28 from the fold line 14 is indicated by "w" in FIG. 8. The spacing "w" arises because a width of top panel 28 is less than that of top panel 12 so the panels 12, 28 will fit properly when the carton 300 is erected.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments, a fold line can be any substantially linear, although not necessarily straight, form of weakening that facilitates folding therealong. More specifically, but not for the purpose of narrowing the scope of the present disclosure, fold lines include: a tear line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include a slit that extends partially into the material along the desired line of weakness, and/or a series of spaced apart slits that extend partially into and/or completely through the material along the desired line of weakness, or various combinations of these features. As a more specific example, one type tear line is a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous tear line. That is, it is within the scope of the present disclosure for each of the tear lines to be replaced with a continuous slit, or the like. For example, a tear line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extend at least partially around an interior of the carton, the plurality of panels comprising a first top panel, a first side panel foldably connected to the first top panel at a first fold line, a second top panel, a second side panel foldably connected to the second top panel at a second fold line, and a bottom panel foldably connected to the first and second side panels, wherein the first top panel and the second top panel are at least partially overlapped to form a top wall of the carton;

a first handle feature in the first top panel;

a second handle feature in the second top panel; and a first opening feature in the first handle feature, the first opening feature comprising at least a first tear line extending to the first fold line, a second tear line collinear to the first fold line intersecting the first tear line, and a third tear line extending from the second tear line into the first side panel, wherein the third tear line terminates in a hook portion;

wherein the first handle feature and the second handle feature are in an overlapping substantially registered relationship to form a carrying handle formation.

2. The carton of claim 1, wherein the first handle feature further comprises a second opening feature, the second opening feature comprising at least a fourth tear line extending to the first fold line, a fifth tear line collinear to the first fold line intersecting the fourth tear line, and a sixth tear line extending from the fifth tear line into the first side panel, wherein the sixth tear line terminates in a hook portion.

3. The carton of claim 2, wherein the first tear line and the fourth tear line are arcuate tear lines.

4. The carton of claim 2, wherein the first handle feature further comprises a first handle panel defined between the first opening feature and the second opening feature.

5. The carton of claim 1, wherein the second tear line of the first opening feature terminates in a hook portion.

6. The carton of claim 1, wherein the first top panel comprises a first panel centerline, wherein the second top panel comprises a second panel centerline, wherein the first handle feature further comprises a plurality of center tear lines substantially parallel to the first panel centerline and wherein the second handle further comprises a plurality of center tear lines substantially parallel to the second panel centerline.

7. The carton of claim 6, wherein the plurality of center tear lines of the first top panel are offset from the first panel centerline and the plurality of center tear lines of the second top panel are offset from the second panel centerline.

8. The carton of claim of 1, wherein the second handle feature comprises a first opening feature, the first opening feature comprising at least a first tear line extending to the second fold line, a second tear line collinear to the second fold line intersecting the first tear line, and a third tear line extending from the second tear line into the second side panel, wherein the third tear line terminates in a hook portion.

9. The carton of claim 8, wherein the second handle feature further comprises a second opening feature, the second opening feature comprising at least a fourth tear line extending to the second fold line, a fifth tear line collinear to the second fold line intersecting the fourth tear line, and a sixth tear line extending from the fifth tear line into the second side panel, wherein the sixth tear line terminates in a hook portion.

10. The carton of claim 9, wherein the first tear line and the fourth tear line of the second handle feature are arcuate tear lines.

11. The carton of claim 9, further comprising a notch extending into the second side panel at a first end of the first tear line of the second handle feature.

12. The carton of claim 1, further comprising a notch extending into the first side panel at a first end of the first tear line.

13. The carton of claim 1, wherein the first tear line is an oblique tear line relative to a panel centerline.

14. The carton of claim 1, further comprising at least two end flaps respectively foldably attached to respective panels of the plurality of panels, wherein the end flaps are overlapped with respect to one another and thereby at least partially form a closed end of the carton.

15. A blank for forming a carton, the blank comprising:

a plurality of panels comprising a first top panel, a first side panel foldably connected to the first top panel at a first fold line, a second top panel, a second side panel foldably connected to the second top panel at a second fold line, and a bottom panel foldably connected to the first and second side panels;

at least two end flaps foldably connected to respective panels of the plurality of panels; and handle features in the first top panel and the second top panel, wherein the handle features are for cooperating to at least partially define a handle in a carton erected from the blank, the handle features comprising:

a first opening feature and a second opening feature, wherein the first and second opening features each comprise a first arcuate tear line at a first end of the opening feature, the first arcuate tear line terminating at the first fold line, a second tear line proximate the first arcuate tear line and collinear to the first fold line, and a third tear line extending from the second tear line into the first side panel and terminating in a hook portion.

16. The blank of claim 15, at least one of the end flaps comprises an intermediate panel arranged between the at least one end flap and respective panel.

17. The blank of claim 15, wherein the first top panel comprises a panel centerline and the second top panel comprises a panel centerline.

18. The blank of claim 17, wherein the first handle further comprises a plurality of center tear lines substantially parallel to the panel centerline of the first top panel and wherein the second handle further comprises a plurality of center tear lines substantially parallel to the panel centerline of the second top panel.

19. The blank of claim 17, wherein the plurality of center tear lines of the first top panel are offset from the panel centerline of the first top panel and the plurality of center tear lines of the second top panel are offset from the panel centerline of the second top panel.

20. The blank of claim 15, wherein the first top panel and the second top panel are different widths with a width of the second top panel being less than a width of the first top panel.

21. The blank of claim 15, wherein the first side panel and the second side panel each comprise at least one angled corner to createa gap between the angled corner and an adjacent end flap.

22. A method of erecting a carton comprising:

obtaining a blank comprising a plurality of panels comprising a first top panel, a first side panel foldably connected to the first top panel at a first fold line, a second top panel, a second side panel foldably connected to the second top panel at a second fold line, and a bottom panel foldably connected to the first and second side panels, the blank further comprising handle features in the first ton panel and the second top panel, the handle features comprising a first opening feature and a second opening feature, wherein the first and second opening features each comprise a first arcuate tear line at a first end of the opening feature, the first arcuate tear line terminating at the first fold line, a second tear line proximate the first arcuate tear line and collinear to the first fold line, and a third tear line extending from the second tear line into the first side panel and terminating in a hook portion;

forming a sleeve from the blank by folding the first top panel, the second top panel, the first side panel and the second side panel along respective fold lines; and forming a top wall of the carton by at least partially overlapping the first top panel over the second top panel, wherein forming the top wall comprises forming a handle from the handle features.

23. The method of claim 22, further comprising grasping the handle to at least partially separate the handle from the top wall and lift the handle above the top wall.

24. The method of claim 23, wherein as the handle is lifted above the top wall a shoulder portion of a first opening feature and a shoulder portion of a second opening feature in the first top and first side panels, and a shoulder portion of a first opening feature and a shoulder portion of a second opening feature in the second top and second side panels engage with the first top panel and second top panel respectively and allow the shoulders to slide along a plurality of arcuate tear lines.

* * * * *